US006019878A

United States Patent [19]

Nidola et al.

[11] Patent Number: 6,019,878

[45] Date of Patent: Feb. 1, 2000

[54] ANODE FOR OXYGEN EVOLUTION IN ELECTROLYTES CONTAINING FLUORIDES OR FLUORIDE-COMPLEX ANIONS

[75] Inventors: Antonio Nidola; Ulderico Nevosi, both of Milan; Rubén Jacobo Ornelas, S. Giuliano Milanese, all of Italy

[73] Assignee: De Nora S.p.A., Italy

[21] Appl. No.: 09/055,660

[22] Filed: Apr. 6, 1998

[30] Foreign Application Priority Data

Apr. 17, 1997 [IT] Italy ..... MI97A0908

[51] Int. Cl.[7] ..... C25B 11/00

[52] U.S. Cl. ..... 204/290 F; 205/261; 205/264; 205/268; 205/284; 205/305

[58] Field of Search ..... 204/290 F; 205/261, 205/264, 268, 284, 305

[56] References Cited

U.S. PATENT DOCUMENTS 4,765,879 8/1988 Matsumoto et al. ..... 204/290 F 4,956,068 9/1990 Nguyen et al. ..... 204/290 F 5,435,896 7/1995 Hardee et al. ..... 204/290 F

*Primary Examiner*—Bruce F. Bell

*Attorney, Agent, or Firm*—Bierman, Muserlian and Lucas

[57] ABSTRACT

The invention discloses a new electrode suitable for use as an anode for oxygen evolution from electrolytes containing fluorides or fluoride-complex anions even in high concentrations.

The anode of the invention comprises a titanium substrate provided with a protective interlayer resistant to the aggressive action of fluorides, and an electrocatalytic coating for oxygen evolution.

The protective interlayer is made of tungsten, oxides or oxyfluorides, optionally containing metals of the platinum group in minor quantities, metallo-ceramic compounds and intermetallic compounds either per se or as mixed oxides.

12 Claims, No Drawings

ANODE FOR OXYGEN EVOLUTION IN ELECTROLYTES CONTAINING FLUORIDES OR FLUORIDE-COMPLEX ANIONS

DESCRIPTION OF THE INVENTION

In the electrometallurgical field, the use of activated titanium anodes, made of a titanium substrate provided with a suitable electrocatalytic coating, is presently limited to a few specific applications such as chromium plating from conventional baths and gold plating.

The active coating may be alternatively based on:

a) platinum (mainly obtained by galvanic deposition)

b) noble metal oxides (mainly obtained by thermal treatment).

Both coatings are satisfactorily performing in sulphuric acid or similar solutions, provided that no fluorides or fluoride-containing anions are present, as it happens with the chromium deposition from conventional electrolytes, where the anodic lifetime reaches three years or more with electrode potentials 0.5 to 1.5 V lower than those typical of lead anodes. Conversely, they find no industrial application in electrolytes containing fluorides. In fact, even small contents of fluorides, in the range of one part per million (hereinafter ppm), irreversibly de-stabilize the anode (maximum lifetime of a few weeks only). It must be noted that the average concentration in industrial electrolytes may vary from some tens of parts per million (ppm) to some grams per liter (g/l). The destabilization of the anode is substantially due to the corrosion of the titanium substrate caused by the fluorides or fluoride-complex anions which make the titanium oxides soluble.

The complexing action of fluorides and fluoride-containing anions, which takes place according to an increasing order as follows: $AlF_6^{3-}$, $FeF_6^{3-}$, $<SiF_6^{2-}<BF_4^-<HF_2^-<F^-$, is accelerated by acidity and temperature.

The presence of fluorides or fluoride-containing anions is normal in electrolytes of many industrial processes, where they are either added to, with the aim of obtaining particular characteristics of the deposited metal, as well as improving deposition speed and penetrating power, or released by the leached minerals.

It has been found that the use of titanium as a substrate for anodes suitable for electrolytes containing fluorides is possible if titanium is subjected, prior to the application of the electrocatalytic coating, to a pre-treatment comprising applying on its surface an interlayer made of elements or compounds potentially stable under the required operating conditions.

The selection criteria for the interlayer characteristics, (components and percentages) and the coating application or formation methods are reported in Tables 1 and 2.

TABLE 1

| Interlayer selection criteria |
|---|
| 1. Fluoride-resistant metals, alloys or oxides thereof, e.g. noble metals (Pt, Pd etc.), mixtures or alloys thereof (Pt—Ir, Pt—Pd ,etc.) and tungsten |
| 2. Oxides or metals convertible to insoluble fluorides or oxyfluorides, e.g. $CeO_2$, $Cr_2O_3$. |
| 3. Oxides resistant to fluorides or convertible to stable fluorides or oxyfluorides, containing definite quantities of noble metals, optionally as mixtures, to enhance electroconductivity. |
| 4. Metallo-ceramic compounds, both electroconductive, due to the metal component, and resistant to fluorides, due to the ceramic part, such as chromium - chromium oxide. |
| 5. Electroconductive and fluoride-resistant intermetallic compounds, such as titanium nitride (TiN), titanium nitride (TiN) + titanium carbide (TiC), tungsten silicide, titanium silicide. |

TABLE 2

Method of production of the interlayer

| Type | Composition | Deposition procedure |
|---|---|---|
| Noble metals, optionally as mixed oxides or as alloys | Pt 100%<br>Pd 100%<br>Pt—Ir (10–30–50%)<br>Pt—Pd<br>Pt—Ir 30%<br>Pt—Pd 70% | Thermal decomposition of precursor salts based on chlorine complexes soluble in diluted aqueous hydrochloric acid<br>Thermal decomposition of isomorphous precursor salts such as $(NH_4)_2Pt(Ir)Cl_6$, $(NH_3)_2Pt(Pd)(NO_2)_2$ |
| Oxides | $Cr_2O_3$ | Plasma jet deposition of preformed oxide powder |
| Composite oxides | $TiO_2$—$Ta_2O_5$—$NbO_2$ (Molar ratio: Ti 75, Ta 20, Nb 5);<br>$TiO_2$—$Ta_2O_5$—$CeO_2$ (Molar ratio: Ti 75,Ta 20 ,Ce 5);<br>$TiO_2$—$Ta_2O_5$—$Cr_2O_3$ (Molar | Thermal decomposition of precursor salts based on chlorometallates soluble in a concentrated hydrochloric solution (HCl ≧ 10%) |

TABLE 2-continued

| Method of production of the interlayer | | |
|---|---|---|
| Type | Composition | Deposition procedure |
| | ratio: Ti 75, Ta 20, Cr 5) | |
| Composite oxides with low content of noble metal | $TiO_2$—$Ta_2O_5$—$IrO_2$ (Molar ratio: Ti 75, Ta 20, Ir 5; Ti 70, Ta 20, Ir 10); $TiO_2$—$Ta_2O_5$—$Nb_2O_5$—$IrO_2$ (Molar ratio: Ti 70, Ta 20, Nb5, Ir 5) | Thermal decomposition of precursor salts based on chlorocomplexes soluble in aqueous hydrochloric acid (≧10%) |
| Metallo-ceramic compounds | Cr (2 microns) - $Cr_2O_3$<br>Cr (20 microns) - $Cr_2O_3$ | Galvanic chromium deposition from a conventional sulphate bath and thermal post-oxidation in air (450° C. - 1 hour). |
| Simple intermetallic compounds | TiN | Plasma jet deposition from a pre-formed powder |
| | TiN | Ionic nitridization |
| | TiN | Nitridization in ammonia (600° C., 3 hours, 10 atm) |
| Composite intermetallic compounds | TiN + TiC | Carbo-nitridization from molten salts |

The invention will be better illustrated by means of some examples wherein samples having the dimensions of 40 mm×40 mm×2 mm, made of titanium grade 2, have been prepared as follows:

a) Surface pretreatment by sandblasting with aluminum oxide powder+pickling in 20% HCl, 30 minutes;

b) application of the protective interlayer;

application of the electrocatalytic coating for oxygen evolution. The samples have been characterized by means of measurement of the electrochemical potential when used as anodes in electrolytes simulating the same operating conditions as in industrial processes and comparison of the results with reference samples prepared according to the prior art teachings.

EXAMPLE 1

No. 64 reference titanium samples, prepared according to the prior art teachings, dimensions 40 mm×40 mm×2 mm each, were subjected to a surface pre-treatment following the procedures mentioned above in item a).

Then, 32 samples, identified by A, were directly activated with an electrocatalytic coating made of Ta—Ir (Ir 64% molar and about the same by weight) and 32 samples, identified by B, were provided with an interlayer based on Ti—Ta (Ta 20% molar) and then with an electrocatalytic coating made of Ta—Ir (Ir 64% molar).

The compositions of the paints are reported in the following table:

| Paint characteristics | Interlayer | | Electrocatalytic coating | |
|---|---|---|---|---|
| Component | $TiCl_3$ $TaCl_5$ | HCl (20%) | $TaCl_5$ $IrCl_3.3H_2O$ | HCl (20%) |
| Content - mg/cc as metal | 5.33 (Ti) | 5.03 (Ta) | 50 (Ta) | 90 (Ir) |

The composition of the layers is described in the following table:

| Characteristics | Stabilizing interlayer | | Electrocatalytic coating | |
|---|---|---|---|---|
| Components | $Ta_2O_5$—$TiO_2$ | | $Ta_2O_5$ $IrO_2$ | |
| % molar as metal | 20 | 80 | 36 | 64 |
| $g/m^2$ as metal or noble metal | Σ1.0 | | 10 | |

The interlayer was applied by brushing the paint. The application was repeated until the desired load was obtained (1.0 g/m$^2$ total metal). Between one application and the subsequent one the paint is subjected to drying at 150° C., followed by thermal decomposition in oven under forced air circulation at 500° C. for 10–15 minutes and subsequent natural cooling.

On the protective interlayer the electrocatalytic coating is applied, also by brushing or equivalent technique. The application is repeated until the desired final load is obtained (10 g/m$^2$ as noble metal). Between one application and the subsequent one the paint is subjected to drying at 150° C., followed by thermal decomposition in oven under forced air circulation at 500° C. for 10–15 minutes and subsequent natural cooling.

EXAMPLE 2

16 electrode samples having the same dimensions as those of Example 1 were prepared according to the present invention, applying various interlayers based on mixed oxides belonging to the transition metals and lanthanides. The samples were pre-treated (sandblasting+pickling) as described in Example 1. The samples were prepared according to the following procedure a) application of the interlayer based on mixed oxides belonging to groups IIIB, IVB, VB, VIB, VIIB and lanthanides, by thermal decomposition of solutions containing the precursor salts of the selected elements.

b) application of the electrocatalytic coating based on tantalum and iridium oxides by thermal decomposition of solutions containing the precursor salts of the selected elements as summarized in Table 2.1

TABLE 2.1

| Sample | Interlayer | | | Electrocatalytic coating | |
|---|---|---|---|---|---|
| | Components | | | Components | |
| No. | Type and %(*) | g/m$^2$(**) | Method | Type, %(*) | Method |
| 2.1 a, b, c, d | Ti—Ta—Y (75)-(20)-(5) | 1.0 | Thermal decomposition from salts based on chlorides or chlorocomplex anions | Ta—Ir (64) | thermal decomposition from same precursor salts as in Example 1 |
| 2.2 a, b, c, d | Ti—Ta—Cr (75)-(20)-(5) | 1.0 | Thermal decomposition from salts based on chlorides or chlorocomplex anions | Ta—Ir (64) | |
| 2.3 a, b, c, d | Ti—Ta—Ce (75)-(20)-(5) | 1.0 | Thermal decomposition from salts based on chlorides or chlorocomplex anions | Ta—Ir (64) | |
| 2.4 a, b, c, d | Ti—Ta—Nb (75)-(20)-(5) | 1.0 | Thermal decomposition from salts based on chlorides or chlorocomplex anions | Ta—Ir (64) | |
| 2.5 a, b, c, d | Ti—Ta—Cr—Nb (70)-(20)-(3)-(7) | 1.0 | Thermal decomposition from salts based on chlorides or chlorocomplex anions | Ta—Ir (64) | |

(*) % molar referred to the elements at the metallic state
(**) (g/m$^2$) total quantity of the metals applied The paints are described in Table 2.2.

TABLE 2.2

| Sample No. | Description of the paints | | | | | |
|---|---|---|---|---|---|---|
| | Interlayer | | | Electrocatalytic coating | | |
| | components | % as metal | mg/cc | components | % as metal | mg/cc |
| 2.1 a, b, c, d | $TaCl_5$ | 20 | 5.54 | $TaCl_5$ | 36 | 50 |
| | $TiCl_4$ | 75 | 5.50 | $IrCl_3$ | 64 | 90 |
| | $YCl_3$ | 5 | 0.68 | HCl | // | 110 |
| | HCl | // | 110 | | | |
| 2.2 a, b, c, d | $TaCl_5$ | 20 | 5.54 | $TaCl_5$ | 36 | 50 |
| | $TiCl_4$ | 75 | 5.50 | $IrCl_3$ | 64 | 90 |

TABLE 2.2-continued

| Sample No. | Description of the paints: Interlayer components | % as metal | mg/cc | Electrocatalytic coating components | % as metal | mg/cc |
|---|---|---|---|---|---|---|
| | $CrO_3$ | 5 | 0.40 | HCl | // | 110 |
| | HCl | // | 110 | | | |
| 2.3 | $TaCl_5$ | 20 | 5.03 | $TaCl_5$ | 36 | 50 |
| a, b, c, d | $TiCl_4$ | 75 | 5.00 | $IrCl_3$ | 64 | 90 |
| | $CeCl_3$ | 5 | 0.97 | HCl | // | 110 |
| | HCl | // | 110 | | | |
| 2.4 | $TaCl_5$ | 20 | 5.03 | $TaCl_5$ | 36 | 50 |
| a, b, c, d | $TiCl_4$ | 75 | 5.00 | $IrCl_3$ | 64 | 90 |
| | $NbCl_5$ | 5 | 0.65 | HCl | // | 110 |
| | HCl | // | 110 | | | |
| 2.5 | $TaCl_5$ | 20 | 5.40 | $TaCl_5$ | 36 | 50 |
| a, b, c, d | $TiCl_4$ | 70 | 5.00 | $IrCl_3$ | 64 | 90 |
| | $CrO_3$ | 3 | 0.24 | HCl | // | 110 |
| | $NbCl_5$ | 7 | 0.97 | | | |
| | HCl | // | 110 | | | |

The method of preparation of the interlayer is described in Table 2.3.

TABLE 2.3

| Preparation of the interlayer |
|---|
| application of the paint containing the precursor salts by brushing or equivalent technique |
| drying at 150° C. and thermal decomposition of the paint at 500° C. for 10–15 minutes in oven under forced air circulation and subsequent natural cooling |
| repeating the application as many times as necessary to obtain the desired load (1.0 g/m$^2$). |

The method for applying the electrocatalytic coating was the same as described in Example 1.

The samples thus prepared were subjected to electrochemical characterization as anodes in four types of electrolytes simulating the industrial operating conditions as shown in Table 2.4. For each type of operating conditions a comparison was made using reference samples prepared as described in Example 1.

TABLE 2.4

| Series | Samples No. | Electrochemical characterization: Operating conditions: Electrolyte | Parameters | Simulated industrial process |
|---|---|---|---|---|
| M | Present invention from 2.1a→2.5a reference samples: A1,B1 | $H_2SO_4$ 150 g/l HF 50 ppm | 500 A/m$^2$ 40° C. | Secondary zinc and copper electrometallurgy |
| N | Present invention: from 2.1b→2.5b reference samples: A2,B2 | $H_2SO_4$ 150 g/l HF 300 ppm | 500 A/m$^2$ 40° C. | Primary copper electrometallurgy |
| O | Present invention: from 2.1c→2.5c reference samples: A3,B3 | $H_2SO_4$ 150 g/l $H_2SiF_6$ 1000 ppm | 1000 A/m$^2$ 60° C. | Chromium plating |
| P | Present invention: from 2.1d→2.5d reference samples: A4,B4 | $H_2SO_4$ 150 g/l $H_2SiF_6$ 1500 ppm | 5000 A/m$^2$ 60° C. | High speed chromium plating |

The characterization comprised:

detecting the electrode potential as a function of the operating time detecting the possible noble metal loss at the end of the test visual inspection.

The results are summarized in Table 2.5.

TABLE 2.5

Results of the electrochemical characterization

| Electrolyte | Samples | Potential V(NHE) initial | 100 h | 1000 h | 3000 h | Morphology |
|---|---|---|---|---|---|---|
| M | 2.1a | 1.62 | 1.68 | 1.80 | 2.01 | No variation |
| | 2.2a | 1.60 | 1.70 | 1.80 | 1.80 | " |
| | 2.3a | 1.56 | 1.65 | 1.70 | 1.75 | " |
| | 2.4a | 1.58 | 1.64 | 1.70 | 1.69 | " |
| | 2.5a | 1.58 | 1.65 | 1.68 | 1.70 | " |
| | A1 | 1.63 | 2.81 | | | Corrosion |
| | B1 | 1.67 | 2.61 | | | Corrosion |
| N | 2.1b | 1.60 | 1.70 | 1.90 | 2.40 | Corrosion |
| | 2.2b | 1.58 | 1.60 | 1.85 | 1.95 | No variation |

TABLE 2.5-continued

| Results of the electrochemical characterization | | | | | | |
|---|---|---|---|---|---|---|
| | | Potential V(NHE) | | | | |
| Electrolyte | Samples | initial | 100 h | 1000 h | 3000 h | Morphology |
| | 2.3b | 1.62 | 1.65 | 1.75 | 1.85 | " |
| | 2.4b | 1.63 | 1.70 | 1.83 | 1.90 | " |
| | 2.5b | 1.61 | 1.65 | 1.70 | 1.75 | " |
| | A2 | 1.69 | 2.81 | | | Corrosion |
| | B2 | 1.67 | 2.61 | | | Corrosion |
| O | 2.1c | 1.78 | 1.84 | 2.03 | >2.6 | Corrosion |
| | 2.2c | 1.75 | 1.80 | 1.85 | 1.90 | No variation |
| | 2.3c | 1.65 | 1.65 | 1.75 | 1.75 | " |
| | 2.4c | 1.60 | 1.70 | 1.72 | 1.80 | " |
| | 2.5c | 1.65 | 1.64 | 1.65 | 1.67 | " |
| | A3 | 1.65 | 3.22 | | | Corrosion |
| | B3 | 1.72 | 3.47 | | | Corrosion |
| P | 2.1d | 1.85 | 1.90 | 2.15 | 4.50 | Corrosion |
| | 2.2d | 1.80 | 1.85 | 2.00 | 3.50 | " |
| | 2.3d | 1.78 | 1.85 | 1.90 | 2.20 | Initial Corrosion |
| | 2.4d | 1.75 | 1.77 | 1.84 | 2.00 | " |
| | 2.5d | 1.84 | 1.85 | 1.97 | 2.20 | " |
| | A4 | 1.87 | >6.0 | | | Corrosion |
| | B4 | 1.92 | >4.5 | | | Corrosion |

The results reported in Table 2.5 point out that the presence of small quantities of metal oxides, which form insoluble compounds in the electrolyte containing fluorides or fluoride-complex anions, increases the lifetime of the electrode of the invention in any operating condition.

EXAMPLE 3

24 samples, same as those of Example 2 with the only exception that the interlayers contained minor amounts of noble metals, after sandblasting and pickling, were prepared according to the following procedure:

a) application of the interlayer based on valve metal oxides containing minor amounts of noble metals, by thermal decomposition of aqueous solutions containing the precursor salts of the selected elements.

b) application of the electrocatalytic coating based on tantalum and iridium oxides applied by thermal decomposition of solutions containing the precursor salts of said elements as summarized in Table 3.1.

TABLE 3.1

| | Interlayer | | | Electrocatalytic coating | |
|---|---|---|---|---|---|
| | Components | | | Components | |
| Samples No. | Type and %(*) | g/m$^2$ (**) | Method | Type and %(*) | Method |
| 3.1 a, b, c, d | Ta—Ti—Ir (20)-(77.5)-(2.5) | 2.0 | thermal decomposition of precursors in hydrochloric solution | Ta—Ir (64%) | Thermal decomposition from precursor salt paints, same as in Example 1 |
| 32 a, b, c, d | Ta—Ti—Ir (20)-(75)-(5) | 2.0 | thermal decomposition or precursors in hydrochloric solution | | |
| 3.3 a, b, c, d | Ta—Ti—Ir (20)-(70)-(10) | 2.0 | thermal decomposition or precursors in hydrochloric solution | | |
| 3.4 a, b, c, d | Ta—Ti—Pd (15)-(80)-(5) | 2.0 | thermal decomposition or precursors in hydrochloric solution | | |
| 3.5 a, b, c, d | Ta—Ti—Ir—Pd (20)-(75)-(2.5) (2.5) | 2.0 | thermal decomposition or precursors in hydrochloric solution | | |
| 3.6 a, b, c, d | Ta—Ti—Nb—Ir (20)-(70)-(5)-(5) | 2.0 | thermal decomposition or precursors in hydrochloric solution | | |

(*) % molar referred to the elements at the metallic state
(**) (g/m$^2$) total quantity of the metals applied The paints are described in Table 3.2.

TABLE 3.2

| 12/21 Paint characteristics | | | | | | |
|---|---|---|---|---|---|---|
| | Interlayer | | | Electrocatalytic coating | | |
| Sample No. | Components | % as metal | mg/cc | Components | % as metal | mg/cc |
| 3.1 | $TaCl_5$ | 20 | 5.30 | $TaCl_5$ | 36 | 50 |
| a, b, c, d | $TiCl_4$ | 77.5 | 5.50 | $IrCl_3$ | 64 | 90 |
| | $IrCl_3$ | 2.5 | 0.70 | HCl | // | 110 |
| | HCl | // | 110 | | | |
| 3.2 | $TaCl_5$ | 20 | 5.54 | $TaCl_5$ | 36 | 50 |
| a, b, c, d | $TiCl_4$ | 75 | 5.50 | $IrCl_3$ | 64 | 90 |
| | $IrCl_3$ | 5.0 | 1.47 | HCl | // | 110 |
| | HCl | // | 110 | | | |
| 3.3 | $TaCl_5$ | 20 | 5.94 | $TaCl_5$ | 36 | 50 |
| a, b, c, d | $TiCl_4$ | 70 | 5.50 | $IrCl_3$ | 64 | 90 |
| | $IrCl_3$ | 10.0 | 3.15 | HCl | // | 110 |
| | HCl | // | 110 | | | |
| 3.4 | $TaCl_5$ | 20 | 3.54 | $TaCl_5$ | 36 | 50 |
| a, b, c, d | $TiCl_4$ | 70 | 5.00 | $IrCl_3$ | 64 | 90 |
| | $PdCl_2$ | 10 | 0.69 | HCl | // | 110 |
| | HCl | // | 110 | | | |
| 3.5 | $TaCl_5$ | 20 | 5.54 | $TaCl_5$ | 36 | 50 |
| a, b, c, d | $TiCl_4$ | 75 | 5.50 | $IrCl_3$ | 64 | 90 |
| | $IrCl_3$ | 2.5 | 0.67 | HCl | // | 110 |
| | $PdCl_2$ | 2.5 | 0.37 | | | |
| | HCl | // | 110 | | | |
| 3.6 | $TaCl_5$ | 20 | 5.40 | $TaCl_5$ | 36 | 50 |
| a, b, c, d | $TiCl_4$ | 70 | 5.00 | $IrCl_3$ | 64 | 90 |
| | $NbCl_5$ | 5 | 0.69 | HCl | // | 110 |
| | $IrCl_3$ | 5 | 1.43 | | | |
| | HCl | // | 110 | | | |

The method of preparation of the interlayer is described in Table 3.3.

TABLE 3.3

| Preparation of the interlayer |
|---|
| application of the paint containing the precursor salts by brushing or equivalent technique |
| drying at 150° C. and thermal decomposition of the paint at 500° C. for 10–15 minutes in oven under forced air circulation and subsequent natural cooling |
| repeating the application as many times as necessary to obtain the desired load (2 $g/m^2$). |

The method for applying the electrocatalytic coating was the same as described in Example 1.

The samples thus prepared were subjected to electrochemical characterization as anodes in four types of electrolytes simulating the industrial operating conditions as shown in Table 3.4. For each type of operating conditions a comparison was made using reference samples prepared as described in Example 1. In particular, in addition to the reference electrodes as described in Example 1, also the best electrode sample of Example 2 (namely sample 2.4) was compared with the present samples.

TABLE 3.4

| Electrochemical characterization | | | | |
|---|---|---|---|---|
| | Sample | Operating conditions | | Simulated |
| Series | No. | Electrolyte | Parameters | industrial process |
| M | Present invention: from 3.1a → 3.6a reference samples: A5, B5, 2.4 | $H_2SO_4$ 150 g/l HF 50 ppm | 500 $A/m^2$ 40° C. | Secondary zinc and copper electrometallurgy |
| N | Present invention: from 3.1b → 3.6b reference samples: A6, B6, 2.4 | $H_2SO_4$ 150 g/l HF 300 ppm | 500 $A/m^2$ 40° C. | Primary copper electrometallurgy |
| O | Present invention: from 3.1c → 3.6c reference samples: A7, B7, 2.4 | $H_2SO_4$ 150 g/l $H_2SiF_6$ 1000 ppm | 1000 $A/m^2$ 60° C. | Conventional chromium plating |

TABLE 3.4-continued

| Series | Sample No. | Electrochemical characterization: Electrolyte | Operating conditions: Parameters | Simulated industrial process |
|---|---|---|---|---|
| P | Present invention: from 3.1d → 3.6d reference samples: A8, B8, 2.4 | $H_2SO_4$ 150 g/l $H_2SiF_6$ 1500 ppm | 5000 A/m$^2$ 60° C. | High speed chromium plating |

The characterization comprised detecting the electrode potential as a function of the operating time, detecting the possible noble metal loss at the end of the test and visual inspection.

The results are summarized in Table 3.5.

TABLE 3.5

Results of the electrochemical characterization

| Electrolyte | Samples | Potential V(NHE) initial | 100 h | 1000 h | 3000 h | Morphology |
|---|---|---|---|---|---|---|
| M | 3.1a | 1.60 | 1.78 | 1.83 | 2.12 | No variation |
| | 3.2a | 1.69 | 1.70 | 1.72 | 1.73 | " |
| | 3.3a | 1.60 | 1.71 | 1.70 | 1.70 | " |
| | 3.4a | 1.58 | 1.65 | 1.66 | 1.67 | " |
| | 3.5a | 1.60 | 1.61 | 1.64 | 1.64 | " |
| | 3.6a | 1.64 | 1.63 | 1.65 | 1.70 | " |
| | 2.4 | 1.58 | 1.64 | 1.70 | 1.69 | " |
| | A5 | 1.63 | 3.15 | | | Corrosion |
| | B5 | 1.66 | 2.19 | | | Corrosion |
| N | 3.1b | 1.64 | 1.79 | 1.98 | 2.35 | Corrosion |
| | 3.2b | 1.63 | 1.74 | 1.78 | 1.79 | No variation |
| | 3.3b | 1.64 | 1.70 | 1.75 | 1.74 | " |
| | 3.4b | 1.62 | 1.68 | 1.68 | 1.72 | " |
| | 3.5b | 1.62 | 1.64 | 1.65 | 1.69 | " |
| | 3.6b | 1.66 | 1.71 | 1.75 | 1.80 | " |
| | 2.4 | 1.63 | 1.70 | 1.83 | 1.90 | " |
| | A6 | 1.63 | 2.75 | | | Corrosion |
| | B6 | 1.67 | 2.31 | | | Corrosion |
| O | 3.1c | 1.77 | 1.83 | 1.97 | >2.5 | Corrosion |
| | 3.2c | 1.75 | 1.75 | 1.83 | 1.91 | No variation |
| | 3.3c | 1.76 | 1.75 | 1.78 | 1.82 | " |
| | 3.4c | 1.74 | 1.75 | 1.75 | 1.80 | " |
| | 3.5c | 1.75 | 1.76 | 1.75 | 1.76 | " |
| | 3.6c | 1.81 | 1.87 | 1.89 | 1.91 | " |
| | 2.4 | 1.60 | 1.70 | 1.72 | 1.80 | " |
| | A7 | 1.68 | 3.19 | | | Corrosion |
| | B7 | 1.79 | 2.66 | | | Corrosion |
| P | 3.1d | 1.86 | 1.89 | 2.12 | 4.6 | Corrosion |
| | 3.2d | 1.81 | 1.85 | 1.97 | 2.9 | " |
| | 3.3d | 1.80 | 1.82 | 1.94 | 2.15 | Initial corrosion |
| | 3.4d | 1.79 | 1.79 | 1.87 | 2.10 | " |
| | 3.5d | 1.78 | 1.79 | 1.83 | 2.06 | " |
| | 3.6d | 1.89 | 1.95 | 1.99 | 2.18 | " |
| | 2.4 | 1.75 | 1.77 | 1.84 | 2.00 | |
| | A8 | 1.90 | >6.0 | | | Corrosion |
| | B8 | 1.92 | >5.0 | | | Corrosion |

The analysis of the results reported in Table 3.5 leads to the conclusion that the presence of noble metals in the interlayer, mainly consisting of transition metal oxides, increases the lifetime of the electrodes of the invention in any type of solutions.

EXAMPLE 4

16 electrode samples having the same dimensions as those of Example 1 were prepared according to the present invention, comprising various metallo-ceramic (cermet) interlayers based on chromium and chromium oxide. The samples were prepared according to the following procedure:

galvanic chromium deposition controlled oxidation with formation of a protective metallo-ceramic interlayer subsequent application of the electrocatalytic coating based on tantalum and iridium.

The method of preparation and the characteristics of the samples are described in Table 4.1.

TABLE 4.1

| Sample No. | Interlayer: Method | Average thickness (micron) | Air oxidation (hours) | Air oxidation (° C.) | Electrocatalytic coating |
|---|---|---|---|---|---|
| 4.1 a, b, c, d | $H_2SO_4$ 3.5 g/l $CrO_3$ 300 g/l 65° C. 1000 A/m$^2$ | 1 | // | // | Ta—Ir (64%) by thermal decomposition from precursor salt paints, as in Example 1 |
| 4.2 a, b, c, d | $H_2SO_4$ 3.5 g/l $CrO_3$ 300 g/l 65° C. 1000 A/m$^2$ | 1 | 1/2 | 400 | Ta—Ir (64%) by thermal decomposition from precursor salt paints, as in Example 1 |
| 4.3 a, b, c, d | $H_2SO_4$ 3.5 g/l $CrO_3$ 300 g/l 65° C. 1000 A/m$^2$ | 1 | 1/2 | 450 | Ta—Ir (64%) by thermal decomposition from precursor salt paints, as in Example 1 |
| 4.4 a, b, c, d | $H_2SO_4$ 3.5 g/l $CrO_3$ 300 g/l 65° C. 1000 A/m$^2$ | 3 | 1/2 | 450 | Ta—Ir (64%) by thermal decomposition from precursor salt paints, as in Example 1 |

The samples thus prepared were subjected to anodic electrochemical characterization in four types of electrolytes simulating the industrial operating conditions as shown in Table 4.2. For each type of operating conditions a comparison was made using reference samples prepared according to the prior art teachings as described in Example 1.

TABLE 4.2

Electrochemical characterization

| Series | Sample No. | Electrolyte | | Operating conditions |
|---|---|---|---|---|
| M | Present invention: from 4.1a→4.4a, reference samples: A9, B9 | $H_2SO_4$<br>HF | 150 g/l<br>50 ppm | 500 A/m$^2$<br>40° C. |
| N | Present invention: from 4.1b→4.4b, reference samples: A10, B10 | $H_2SO_4$<br>HF | 150 g/l<br>300 ppm | 500 A/m$^2$<br>50° C. |
| O | Present invention: from 4.1c→4.4c, reference samples: A11. B11 | $H_2SO_4$<br>$H_2SiF_6$ | 150 g/l<br>1000 ppm | 1000 A/m$^2$<br>60° C. |
| P | Present invention: from 4.1d→4.4d, reference samples A12, B12 | $H_2SO_4$<br>$H_2SiF_6$ | 150 g/l<br>1000 ppm | 5000 A/m$^2$<br>60° C. |

The characterization comprised detecting the electrode potential as a function of the operating time, detecting the possible noble metal loss at the end of the test and visual inspection.

The results are summarized in Table 4.3.

TABLE 4.3

Results of the electrochemical characterization

| Electrolyte | Samples | Potential (V(NHE) initial | 100 h | 1000 h | 3000 h | Morphology |
|---|---|---|---|---|---|---|
| M | 4.1a | 1.81 | >3.0 | | | Corrosion |
| | 4.2a | 1.75 | 1.75 | >3.0 | | Corrosion |
| | 4.3a | 1.74 | 1.74 | 1.75 | 1.89 | No variation |
| | 4.4a | 1.78 | 1.76 | 1.76 | 1.79 | " |
| | A9 | 1.62 | 2.90 | | | Corrosion |
| | B9 | 1.65 | 2.31 | | | Corrosion |
| N | 4.1b | 1.83 | >4.0 | | | Corrosion |
| | 4.2b | 1.77 | 1.98 | >3.6 | | Corrosion |
| | 4.3b | 1.75 | 1.77 | 1.78 | 1.89 | No variation |
| | 4.4b | 1.78 | 1.79 | 1.82 | 1.83 | " |
| | A10 | 1.63 | 2.98 | | | Corrosion |
| | B10 | 1.67 | 2.22 | | | Corrosion |
| O | 4.1c | 1.89 | >5.0 | | | Corrosion |
| | 4.2c | 1.86 | 1.86 | >2.5 | | Corrosion |
| | 4.3c | 1.83 | 1.84 | 1.85 | 1.91 | No variation |
| | 4.4c | 1.82 | 1.84 | 1.85 | 1.86 | " |
| | A11 | 1.68 | 3.12 | | | Corrosion |
| | B11 | 1.75 | 2.55 | | | Corrosion |
| P | 4.1d | 1.93 | >5.0 | | | Corrosion |
| | 4.2d | 1.90 | 1.92 | >2.5 | | Corrosion |
| | 4.3d | 1.88 | 1.88 | 1.89 | 1.94 | No variation |
| | 4.4d | 1.87 | 1.87 | 1.87 | 1.90 | " |
| | A12 | 1.84 | >5.5 | | | Corrosion |
| | B12 | 1.89 | >4.0 | | | Corrosion |

The analysis of the results leads to the conclusion that the electrodes of the invention obtained by galvanic deposition and thermal oxidation are more stable than those of the prior art. In particular this stability (corrosion resistance, weight loss and potential with time) increases according to the following order, depending on the type of substrate:

| | | | | | | |
|---|---|---|---|---|---|---|
| Cr<br>1 micron | < | Cr + oxidation<br>1 micron 400° C. | < | Cr + oxidation<br>1 micron 450° C. | < | Cr + oxidation<br>3 micron 450° C. |

EXAMPLE 5

12 electrode samples comprising various interlayers based on titanium nitride and having the same dimensions as those of Example 1 were prepared following the same pretreatment procedure described in Example 1. Nitridization was subsequently carried out by in-situ formation of a protective titanium nitride interlayer and the electrocatalytic coating was then applied (Table 5.1). The in situ formation was obtained by the conventional thermal decomposition technique of reactant gases or by ionic gas deposition.

TABLE 5.1

Method of forming the interlayer and the electrocatalytic coating

| Sample No. | Interlayer Composition | Thickness (micron) | Method | Electrocatalytic coating |
|---|---|---|---|---|
| 5.1a,b,c,d | TiN | 3–3.1 | Plasma jet deposition of TiN powder (0.5–1.0 micron) | Ta—Ir (64%), Thermal decomposition from precursor salt paints, as in Example 1 |
| 5.2a,b,c,d | TiN | 2.9–3.0 | "in situ" formation by ionic nitridization: gas: $N_2$ pressure: 3–10 millibar temperature: 580° C. | Ta—Ir (64%), Thermal decomposition from precursor salt paints, as in Example 1 |
| 5.3a,b,c,d | TiN | 2.9–3.1 | "in situ" formation by gas nitridization: gas: $NH_3$ catalyst: palladiate carbon pressure: 3–4 atm temperature: 580° C. | Ta—Ir (64%), Thermal decomposition from precursor salt paints, as in Example 1 |

The samples thus prepared were subjected to electrochemical characterizations anodes in four types of electrolytes simulating the industrial operating conditions as shown in Table 5.2. For each type of operating conditions a comparison was made using reference samples prepared according to the prior art teachings as described in Example 1.

TABLE 5.2

Electrochemical characterization

| Series | Sample No. | Electrolyte | | Operating Conditions |
|---|---|---|---|---|
| M | Present invention: from 5.1a→5.3a, reference samples: A13, B13 | $H_2SO_4$<br>HF | 150 g/l<br>50 ppm | 500 A/m$^2$<br>40° C. |
| N | Present invention: from 5.1b→5.3b, reference samples: A14, B14 | $H_2SO_4$<br>HF | 150 g/l<br>300 ppm | 500 A/m$^2$<br>50° C. |
| O | Present invention: from 5.1c→5.3c, reference samples: A15, B15 | $H_2SO_4$<br>$H_2SiF_6$ | 150 g/l<br>1000 ppm | 1000 A/m$^2$<br>60° C. |

TABLE 5.2-continued

| Electrochemical characterization | | | | |
|---|---|---|---|---|
| Series | Sample No. | Electrolyte | | Operating Conditions |
| P | Present invention: from 5.1d→5.3d reference samples: A16, B16 | $H_2SO_4$<br>$H_2SiF_6$ | 150 g/l<br>1000 ppm | 5000 A/m$^2$<br>60° C. |

The characterization comprised:

detecting the electrode potential as a function of the operating time detecting the possible noble metal loss at the end of the test visual inspection.

The results are summarized in Table 5.3.

TABLE 5.3

| Results of the characterization | | | | | | |
|---|---|---|---|---|---|---|
| | | Potential (V(NHE) | | | | |
| Electrolyte | Samples | initial | 100 h | 1000 h | 3000 h | morphology |
| M | 5.1a | 1.8 | 1.81 | 1.81 | 1.84 | No variation |
| | 5.2a | 1.78 | 1.79 | 1.79 | 1.81 | " |
| | 5.3a | 1.83 | 1.84 | 1.88 | 1.85 | " |
| | A13 | 1.63 | 3.05 | | | Corrosion |
| | B13 | 1.66 | 2.44 | | | Corrosion |
| N | 5.1b | 1.83 | 1.83 | 1.86 | 1.89 | No variation |
| | 5.2b | 1.79 | 1.82 | 1.84 | 1.86 | " |
| | 5.3b | 1.85 | 1.85 | 1.91 | 1.95 | " |
| | A14 | 1.62 | 2.87 | | | Corrosion |
| | B14 | 1.68 | 2.25 | | | Corrosion |
| O | 5.1c | 1.87 | 1.87 | 1.89 | 1.93 | No variation |
| | 5.2c | 1.85 | 1.84 | 1.85 | 1.90 | " |
| | 5.3c | 1.91 | 1.93 | 1.98 | 2.08 | Initial corrosion |
| | A15 | 1.65 | 3.23 | | | Corrosion |
| | B15 | 1.73 | 2.57 | | | Corrosion |
| P | 5.1d | 1.90 | 1.91 | 1.92 | 1.95 | No variation |
| | 5.2d | 1.88 | 1.88 | 1.89 | 1.90 | Initial corrosion |
| | 5.3d | 1.93 | 1.98 | 2.05 | 2.12 | Initial corrosion |
| | A16 | 1.82 | >5.5 | | | Corrosion |
| | B16 | 1.92 | >4.5 | | | Corrosion |

The analysis of the results leads to the following conclusions:

the electrodes of the invention are more stable than those of the prior art;

the electrodes with a TiN interlayer obtained both by plasma jet deposition and by ionic nitridization are more stable in all operating conditions;

the electrodes with a TiN interlayer obtained by gas ($NH_3$) nitridization are stable in those operating conditions where the fluoride content remains below 1000 ppm.

EXAMPLE 6

12 electrode samples comprising various interlayers based on intermetallic compounds comprising titanium nitrides (major component) and titanium carides (minor component) and having the same dimensions as those of Example 1 were prepared following the same pre-treatment procedure described in Example 1. Activation was subsequently carried out by carbonitridization of the samples by thermal treatment in molten salts (in situ formation of the protective interlayer of titanium nitrides and carbides)

application of the electrocatalytic coating as described in Table. 6.1.

TABLE 6.1

| Method of forming the interlayer and the electrocatalytic coating | | | | |
|---|---|---|---|---|
| | Interlayer | | | |
| Sample No. | Composition % by weight | Thickness (micron) | Method | Electrocatalytic coating |
| 6.1 a,b,c,d | TiN ≦ 80<br>TiC ≧ 20 | 0.8–1.5 | Immersion in molten salts: NaCN + $Na_2CO_3$ + $Li_2CO_3$ (550° C.) for 30 minutes | Ta—Ir (64%), by from precursor salt paints as in Example 1 |
| 6.2 a,b,c,d | TiN ≧ 90<br>TiC ≦ 10 | 3–3.5 | Immersion in molten salts: NaCN + $Na_2CO_3$ + $Li_2CO_3$ (550° C.) for 90 minutes | Ta—Ir (64%), by from precursor salt paints as in Example 1 |
| 6.3 a,b,c,d | TiN ≧ 90<br>TiC ≦ 10 | 5–5.3 | Immersion in molten salts: NaCN + $Na_2CO_3$ + $Li_2CO_3$ (550° C.) for 120 minutes | Ta—Ir (64%), by from precursor salt paints as in Example 1 |

The samples thus prepared were subjected to electrochemical characterization as anodes in four types of electrolytes simulating the industrial operating conditions as shown in Table 6.2. For each type of operating conditions a comparison was made using reference samples prepared according to the prior art teachings as described in Example 1.

TABLE 6.2

| Electrochemical characterization | | | | |
|---|---|---|---|---|
| Series | Sample No. | Electrolyte | | Operating conditions |
| M | Present invention: from 6.1a→6.3a, reference samples: A17, B17 | $H_2SO_4$<br>HF | 150 g/l<br>50 ppm | 500 A/m$^2$<br>40° C. |
| N | Present invention: from 6.1b→6.3b, reference samples: A18, B18 | $H_2SO_4$<br>HF | 150 g/l<br>300 ppm | 500 A/m$^2$<br>50° C. |
| O | Present invention: from 6.1c→6.3c, reference samples: A19, B19 | $H_2SO_4$<br>$H_2SiF_6$ | 150 g/l<br>1000 ppm | 1000 A/m$^2$<br>60° C. |
| P | Present invention: from 6.1d→6.3d, reference samples: A20, B20 | $H_2SO_4$<br>$H_2SiF_6$ | 150 g/l<br>1000 ppm | 5000 A/m$^2$<br>60° C. |

The characterization comprised:

detecting the electrode potential as a function of the operating time detecting the possible noble metal loss at the end of the test visual inspection.

The results are summarized in Table 6.3

TABLE 6.3

| Results of the characterization | | | | | | |
|---|---|---|---|---|---|---|
| | | Potential V/NHE | | | | |
| Electrolyte | Samples | initial | 100 h | 1000 h | 3000 h | Morphology |
| M | 6.1a | 1.74 | 1.80 | 1.83 | 1.89 | No variation |
| | 6.2a | 1.80 | 1.80 | 1.80 | 1.85 | " |
| | 6.3a | 1.81 | 1.80 | 1.81 | 1.88 | No variation |
| | A17 | 1.66 | 3.19 | | | Corrosion |
| | B17 | 1.67 | 2.41 | | | Corrosion |
| N | 6.1b | 1.80 | 1.81 | 1.84 | 1.88 | No variation |
| | 6.2b | 1.80 | 1.81 | 1.81 | 1.86 | " |
| | 6.3b | 1.81 | 1.82 | 1.82 | 1.82 | " |
| | A18 | 1.62 | 2.95 | | | Corrosion |
| | B18 | 1.66 | 2.26 | | | Corrosion |
| O | 6.1c | 1.83 | 1.89 | 1.90 | 1.95 | No variation |
| | 6.2c | 1.83 | 1.84 | 1.84 | 1.91 | " |
| | 6.3c | 1.84 | 1.85 | 1.84 | 1.92 | " |
| | A19 | 1.67 | 3.19 | | | Corrosion |
| | B19 | 1.74 | 2.61 | | | Corrosion |
| P | 6.1d | 1.91 | 1.94 | 1.97 | 2.38 | No variation |
| | 6.2d | 1.90 | 1.91 | 1.91 | 1.96 | " |
| | 6.3d | 1.92 | 1.94 | 1.93 | 1.94 | " |
| | A20 | 1.84 | >6.0 | | | Corrosion |
| | B20 | 1.90 | >5.0 | | | Corrosion |

The analysis of the results leads to the following considerations all the electrodes of the invention are more stable than those of the prior art;

in particular, the best performance was recorded by the samples prepared with the longest treatment time in the molten salt bath.

EXAMPLE 7

18 electrode samples having the dimensions of 40 mm×40 mm×2 mm, were prepared applying an interlayer based on tungsten, by plasma jet deposition of a tungsten powder having an average grain size of 0.5–1.5 micron. An electrocatalytic coating was then applied as described in Table 7.1.

TABLE 7.1

| Method of application of the interlayer and electrocatalytic coating | | |
|---|---|---|
| Sample No. | Interlayer Thickness (micron) | Electrocatalytic coating |
| 7.1a,b,c,d,e,f | 15–25 | Thermal decomposition of precursor salts of Ta—Ir (64%) as in Example 1. |
| 7.2a,b,c,d,e,f | 30–40 | Thermal decomposition of precursor salts of Ta—Ir (64%) as in Example 1. |
| 7.3a,b,c,d,e,f | 70–80 | Thermal decomposition of precursor salts of Ta—Ir (64%) as in Example 1. |

The samples thus prepared were subjected to electrochemical characterization as anodes in six types of electrolytes simulating the industrial operating conditions as shown in Table 7.2.

TABLE 7.2

| Electrochemical characterization | | | | |
|---|---|---|---|---|
| Series | Sample No. | Electrolyte | | Operating conditions |
| M | Present invention: from 7.1a→7.3a, reference samples: A21, B21, 2.4 (Example 2). | $H_2SO_4$ HF | 150 g/l 50 ppm | 500 A/m$^2$ 40° C. |
| N | Present invention: from 7.1b→7.3b, reference samples: A22, B22, 2.4 (Example 2). | $H_2SO_4$ HF | 150 g/l 300 ppm | 500 A/m$^2$ 50° C. |
| O | Present invention: from 7.1c→7.3c, reference samples: A23, B23, 2.4 (Example 2). | $H_2SO_4$ $H_2SiF_6$ | 150 g/l 1000 ppm | 1000 A/m$^2$ 60° C. |
| P | Present invention: from 7.1d→7.3d, reference samples: A24, B24, 2.4 (Example 2). | $H_2SO_4$ $H_2SiF_6$ | 150 g/l 1500 ppm | 5000 A/m$^2$ 60° C. |
| Q | Present invention: from 7.1e→7.3e, reference samples: A25, B25, 2.4 (Example 2). | $H_2SiF_6$ | 50 g/l | 500 A/m$^2$ 60° C. |
| R | Present invention: from 7.1f→7.3f, reference samples: A26, B26, 2.4 (Example 2). | $HBF_4$ | 50 g/l | 500 A/m$^2$ 60° C. |

The characterization comprised:

detecting the electrode potential as a function of the operating time detecting the possible noble metal loss at the end of the test visual inspection.

The results are summarized in Table 7.3.

TABLE 7.3

| Results of the electrochemical characterization | | | | | | |
|---|---|---|---|---|---|---|
| | | Potential V(NHE) | | | | |
| Electrolyte | Samples | initial | 100 h | 1000 h | 3000 h | Morphology |
| M | 7.1a | 1.7 | 1.71 | 1.73 | 1.78 | No variation |
| | 7.2a | 1.71 | 1.70 | 1.70 | 1.71 | " |
| | 7.3a | 1.68 | 1.67 | 1.68 | 1.68 | " |
| | A21 | 1.63 | 3.05 | | | Corrosion |
| | B21 | 1.66 | 2.44 | | | Corrosion |
| | 2.4 | 1.58 | 1.64 | 1.70 | 1.69 | No variation |
| N | 7.1b | 1.71 | 1.72 | 1.75 | 1.82 | " |
| | 7.2b | 1.70 | 1.70 | 1.69 | 1.69 | " |
| | 7.3b | 1.67 | 1.70 | 1.68 | 1.68 | " |
| | A23 | 1.63 | 2.89 | | | Corrosion |
| | B23 | 1.67 | 2.36 | | | Corrosion |
| | 2.4 | 1.63 | 1.70 | 1.83 | 1.90 | No variation |
| O | 7.1c | 1.72 | 1.74 | 1.78 | 1.86 | " |
| | 7.2c | 1.70 | 1.70 | 1.72 | 1.72 | " |
| | 7.3c | 1.70 | 1.70 | 1.71 | 1.69 | " |
| | A24 | 1.66 | 3.47 | | | Corrosion |
| | B24 | 1.76 | 2.81 | | | Corrosion |
| | 2.4 | 1.63 | 1.70 | 1.72 | 1.80 | No variation |
| P | 7.1d | 1.74 | 1.76 | 1.86 | 1.89 | " |
| | 7.2d | 1.73 | 1.75 | 1.75 | 1.75 | " |
| | 7.3d | 1.73 | 1.73 | 1.74 | 1.74 | " |
| | A24 | 1.84 | 3.05 | | | Corrosion |
| | B24 | 1.94 | 3.10 | | | Corrosion |
| | 2.4 | 1.75 | 1.77 | 1.84 | 2.00 | Initial corrosion |
| Q | 7.1e | 1.66 | 1.69 | 1.83 | 1.86 | Initial corrosion |
| | 7.2e | 1.68 | 1.68 | 1.68 | 1.67 | Initial corrosion |

TABLE 7.3-continued

Results of the electrochemical characterization

| Electrolyte | Samples | Potential V(NHE) initial | 100 h | 1000 h | 3000 h | Morphology |
|---|---|---|---|---|---|---|
| | 7.3e | 1.67 | 1.69 | 1.68 | 1.68 | Initial corrosion |
| | A25 | 1.65 | >4.0 | | | Initial corrosion |
| | B25 | 1.68 | >4.0 | | | Corrosion |
| | 2.4 | 1.70 | 1.90 | 2.1 | | Corrosion |
| R | 7.1f | 1.65 | 1.70 | 1.77 | 1.79 | No variation |
| | 7.2f | 1.67 | 1.67 | 1.68 | 1.69 | " |
| | 7.3f | 1.65 | 1.66 | 1.66 | 1.66 | " |
| | A26 | 1.66 | >4.0 | | | Corrosion |
| | B26 | 1.70 | >5.0 | | | Corrosion |
| | 2.4 | 1.75 | 1.95 | 2.5 | | Corrosion |

The analysis of the results lead to the conclusions that all the samples according to the present invention are more stable than those prepared according to the prior art teachings, in particular, the electrodes provided with the tungsten interlayer are stable also in concentrated fluoboric or fluosilicic baths where the samples of the previous examples became corroded.

EXAMPLE 8

36 electrode samples having the dimensions of 40 mm×40 mm×2 mm, were prepared by applying an interlayer based on suicides, precisely tungsten silicide and titanium silicide, by plasma jet deposition after the same pretreatment as described in Example 1. An electrocatalytic coating was then applied as described in Table 8.1.

TABLE 8.1

Method of application of the interlayer and electrocatalytic coating

| Sample No. | Interlayer Composition | Thickness (micron) | Method | Electrocatalytic coating |
|---|---|---|---|---|
| 8.1a,b,c,d,e,f | $WSi_2$ | 20–30 | Plasma jet deposition of $WSi_2$ powder (0.5–1.5 micron) | Ta—Ir (64%), by thermal decomposition starting from precursor salt paints as in Example 1 |
| 8.2a,b,c,d,e,f | $WSi_2$ | 40–50 | Plasma jet deposition of $WSi_2$ powder (0.5–1.5 micron) | Ta—Ir (64%), by thermal decomposition starting from precursor salt paints as in Example 1 |
| 8.3a,b,c,d,e,f | $WSi_2$ | 70–80 | Plasma jet deposition of $WSi_2$ powder (0.5–1.5 micron) | Ta—Ir (64%), by thermal decomposition starting from precursor salt paints as in Example 1 |
| 8.4a,b,c,d,e,f | $TiSi_2$ | 20–30 | Plasma jet deposition of $TiSi_2$ (0.5–1.5 micron) powder | Ta—Ir (64%), by thermal decomposition starting from precursor salt paints as in Example 1 |
| 8.5a,b,c,d,e,f | $TiSi_2$ | 40–50 | Plasma jet deposition of $TiSi_2$ (0.5–1.5 micron) powder | Ta—Ir (64%), by thermal decomposition starting from precursor salt paints as in Example 1 |

TABLE 8.1-continued

Method of application of the interlayer and electrocatalytic coating

| Sample No. | Interlayer Composition | Thickness (micron) | Method | Electrocatalytic coating |
|---|---|---|---|---|
| 8.6a,b,c,d,e,f | $TiSi_2$ | 70–80 | Plasma jet deposition of $TiSi_2$ (0.5–1.5 micron) powder | Ta—Ir (64%), by thermal decomposition starting from precursor salt paints as in Example 1 |

The samples thus prepared were subjected to electrochemical characterization as anodes in six types of electrolytes simulating industrial operating conditions as shown in Table 8.2. For each type of operating conditions a comparison was made with some reference samples prepared according to the prior art teachings as described in Example 1 and a sample of Example 2 of the invention (sample 2.4).

TABLE 8.2

Electrochemical characterization

| Series | Sample No. | Electrolyte | | Operating Conditions |
|---|---|---|---|---|
| M | 8.1a→8.3a, reference samples: A27, B27, 2.4 (Example 2) | $H_2SO_4$ HF | 150 g/l 50 ppm | 500 A/m$^2$ 40° C. |
| N | 8.1b→8.3b, reference samples: A28, B28, 2.4 (Example 2) | $H_2SO_4$ HF | 150 g/l 300 ppm | 500 A/m$^2$ 50° C. |
| O | 8.1c→8.3c, reference samples: A29, B29, 2.4 (Example 2) | $H_2SO_4$ $H_2SiF_6$ | 150 g/l 1000 ppm | 1000 A/m$^2$ 60° C. |
| P | 8.1d→8.3d, reference samples: A30, B30, 2.4 (Example 2) | $H_2SO_4$ $H_2SiF_6$ | 150 g/l 1500 ppm | 5000 A/m$^2$ 60° C. |
| Q | Present invention: from 8.1e→8.3e, reference samples: A31, B31, 2.4 (Example 2) | $H_2SiF_6$ | 50 g/l | 500 A/m$^2$ 60° C. |
| R | 8.1f→8.3f, reference samples: A32, B32, 2.4 (Example 2) | $HBF_4$ | 50 g/l | 500 A/m$^2$ 60° C. |

The characterization comprised:

detecting the electrode potential as a function of the operating time detecting the possible noble metal loss at the end of the test visual inspection.

The results are summarized in Table 8.3.

TABLE 8.3

Results of the electrochemical characterization

| Electrolyte | Samples | Potential V(NHE) initial | 100 h | 1000 h | 3000 h | Morphology |
|---|---|---|---|---|---|---|
| M | 8.1a | 1.74 | 1.74 | 1.78 | 1.81 | No variation |
| | 8.2a | 1.72 | 1.73 | 1.75 | 1.75 | No variation |
| | 8.3a | 1.70 | 1.71 | 1.71 | 1.72 | No variation |
| | 8.4a | 1.75 | 1.75 | 1.80 | 1.84 | No variation |
| | 8.5a | 1.74 | 1.74 | 1.77 | 1.77 | No variation |

TABLE 8.3-continued

Results of the electrochemical characterization

| Electrolyte | Samples | Potential V(NHE) initial | 100 h | 1000 h | 3000 h | Morphology |
|---|---|---|---|---|---|---|
| | 8.6a | 1.69 | 1.71 | 1.70 | 1.73 | No variation |
| | A27 | 1.63 | 3.05 | | | Corrosion |
| | B27 | 1.69 | 2.44 | | | Corrosion |
| | 2.4 | 1.58 | 1.64 | 1.70 | 1.69 | No variation |
| N | 8.1b | 1.72 | 1.76 | 1.77 | 1.82 | No variation |
| | 8.2b | 1.71 | 1.71 | 1.71 | 1.74 | No variation |
| | 8.3b | 1.70 | 1.71 | 1.72 | 1.72 | No variation |
| | 8.4b | 1.77 | 1.78 | 1.77 | 1.90 | No variation |
| | 8.5b | 1.72 | 1.73 | 1.73 | 1.73 | No variation |
| | 8.6b | 1.73 | 1.72 | 1.70 | 1.72 | No variation |
| | A28 | 1.62 | 2.89 | | | Corrosion |
| | B28 | 1.71 | 2.36 | | | Corrosion |
| | 2.4 | 1.63 | 1.70 | 1.83 | 1.90 | No variation |
| O | 8.1c | 1.75 | 1.75 | 1.79 | 1.84 | No variation |
| | 8.2c | 1.70 | 1.70 | 1.75 | 1.75 | No variation |
| | 8.3c | 1.70 | 1.73 | 1.73 | 1.74 | No variation |
| | 8.4c | 1.76 | 1.81 | 1.82 | 1.86 | No variation |
| | 8.5c | 1.72 | 1.76 | 1.77 | 1.79 | No variation |
| | 8.6c | 1.72 | 1.75 | 1.76 | 1.77 | No variation |
| | A29 | 1.67 | 3.47 | | | Corrosion |
| | B29 | 1.76 | 2.81 | | | Corrosion |
| | 2.4 | 1.63 | 1.70 | 1.72 | 1.80 | No variation |
| P | 8.1d | 1.75 | 1.76 | 1.79 | 1.90 | No variation |
| | 8.2d | 1.74 | 1.74 | 1.76 | 1.77 | No variation |
| | 8.3d | 1.75 | 1.75 | 1.75 | 1.78 | No variation |
| | 8.4d | 1.76 | 1.77 | 1.78 | 1.88 | No variation |
| | 8.5d | 1.74 | 1.76 | 1.75 | 1.77 | No variation |
| | 8.6d | 1.76 | 1.77 | 1.77 | 1.79 | No variation |
| | A30 | 1.84 | 3.05 | | | Corrosion |
| | B30 | 1.94 | 3.10 | | | Corrosion |
| | 2.4 | 1.75 | 1.77 | 1.84 | 2.00 | Initial corrosion |
| Q | 8.1e | 1.68 | 1.68 | 1.75 | 1.84 | No variation |
| | 8.2e | 1.67 | 1.67 | 1.71 | 1.74 | No variation |
| | 8.3e | 1.65 | 1.70 | 1.70 | 1.70 | No variation |
| | 8.4e | 1.66 | 1.66 | 1.74 | 1.89 | No variation |
| | 8.5e | 1.71 | 1.70 | 1.73 | 1.76 | No variation |
| | 8.6e | 1.73 | 1.72 | 1.73 | 1.78 | No variation |
| | A31 | 1.64 | >2.0 | | | No variation |
| | B31 | 1.68 | >4.0 | | | Corrosion |
| | 2.4 (Ex. 2) | 1.70 | 1.90 | 2.1 | | Corrosion |
| R | 8.1f | 1.66 | 1.67 | 1.68 | 1.92 | No variation |
| | 8.2f | 1.67 | 1.67 | 1.71 | 1.73 | No variation |
| | 8.3f | 1.70 | 1.72 | 1.72 | 1.73 | No variation |
| | 8.4f | 1.70 | 1.72 | 1.78 | 1.89 | No variation |
| | 8.5f | 1.74 | 1.74 | 1.73 | 1.73 | No variation |
| | 8.6f | 1.70 | 1.70 | 1.72 | 1.75 | No variation |
| | A32 | 1.66 | >4.0 | | | Corrosion |
| | B32 | 1.70 | >5.0 | | | Corrosion |
| | 2.4 (Ex. 2) | 1.75 | 1.95 | 2.5 | | Corrosion |

The analysis of the results lead to the following conclusions:

all the samples according to the present invention are more stable than those prepared according to the prior art teachings;

in particular, the electrodes provided with the titanium or tungsten silicide interlayer are stable also in concentrated fluoboric or fluosilicic baths wherein the samples of the previous example 2 became corroded.

The above discussion clearly illustrates the distinctive features of the present invention and some preferred embodiments of the same. However, further modifications are possible without departing from the scope of the invention, which is limited only by the following appended claims.

We claim:

1. An anode for electrometallurgical process using acid solution containing fluorides, consisting essentially of a titanium substrate provided with a protective interlayer and an outer electrocatalytic coating for oxygen evolution wherein the said interlayer is made of tungsten.

2. In the method for electroplating a metal onto a cathode the improvement comprises using as the anode the anode of claim 1.

3. The method of claim 2 wherein the metal being plated is selected from the group consisting of chromium, zinc, gold, and platinum.

4. An anode for electrometallurgical processes using acid solutions containing fluorides or fluoride-complex anions, consisting essentially of a titanium substrate provided with a protective interlayer and an outer electrocatalytic coating for oxygen evolution wherein the said interlayer is selected from the group consisting of oxides oxyfluorides and mixed oxides of at least one metal selected from the group consisting of chromium, yttrium, cerium, lanthanides, titanium and niobium.

5. The anode of claim 4 wherein the interlayer further contains minor amount of platinum group metals, or as a mixture thereof.

6. The anode of claim 5 wherein said metals of the platinum group are platinum, palladium and iridium.

7. Anode for electrochemical processes using acid solutions containing fluorides or fluoride-complex anions, comprising a titanium substrate provided with a protective interlayer and an electrocatalytic coating for oxygen evolution characterized in that said interlayer is made of a metalloceramic mixture.

8. The anode of claim 7 wherein said metalloceramic mixture contains chromium as the metal component and chromium oxide as the ceramic component.

9. An anode for electrometallurgical processes using acid solutions containing fluorides or fluoride-complex anions, consisting essentially of a titanium substrate provided with a protective interlayer and an outer electrocatalytic coating for oxygen evolution wherein the said interlayer is made of intermetallic compounds or as a mixture thereof.

10. The anode of claim 9 wherein the said intermetallic compounds are selected from the group consisting of nitrides, carbides and silicides.

11. The anode of claim 10 wherein the said intermetallic compounds are selected from the group consisting of titanium nitrides, carbides and silicides and tungsten silicides.

12. In the method for electroplating a metal onto a cathode the improvement comprises using as the anode the anode of claim 7.

* * * * *